United States Patent [19]

Ruda

[11] 3,974,959

[45] Aug. 17, 1976

[54] BAG HAVING MODIFIED CLOSURE FLAPS

[75] Inventor: Raymond J. Ruda, Chicago, Ill.

[73] Assignee: Bagcraft Corporation of America, Chicago, Ill.

[22] Filed: Oct. 9, 1974

[21] Appl. No.: 513,336

[52] U.S. Cl. ..... 229/62; 229/38; 229/44 R

[51] Int. Cl.[2] ..... B65D 33/16

[58] Field of Search ..... 229/44 R, 53, 62, 38

[56] References Cited

UNITED STATES PATENTS

| | | | |
|---|---|---|---|
| 647,897 | 4/1900 | Kramer | 229/38 |
| 2,774,531 | 12/1956 | Rosenthal | 229/53 |

FOREIGN PATENTS OR APPLICATIONS

| | | | |
|---|---|---|---|
| 148,834 | 10/1952 | Australia | 229/53 |
| 136,395 | 2/1950 | Australia | 229/62 |
| 120,867 | 2/1948 | Sweden | 229/38 |
| 587,167 | 4/1947 | United Kingdom | 229/53 |

*Primary Examiner*—Stephen P. Garbe
*Attorney, Agent, or Firm*—Hill, Gross, Van Santen, Steadman, Chiara & Simpson

[57] ABSTRACT

A paper bag has a conventional rectangular bottom and has its side panels so cut and scored at the other end as to define four end panels arranged to provide a reclosable rectangular end at the mouth of the bag.

1 Claim, 5 Drawing Figures

BAG HAVING MODIFIED CLOSURE FLAPS

BACKGROUND OF THE INVENTION

1. Field of the Invention

This invention relates to collapsible paper bags such as of the pleated satchel-bottom type which has means for reclosing the open end.

2. Prior Art

Pleated satchel bottom bags and other rectangular bottom bags are known in the art and closure means have been provided in the past for the open end, the most common being a paper covered wire known in the trade as a "tin tie". With such an arrangement, the bag functions in a conventional manner.

It has also been known heretofore to use collapsible paper board cartons which are usually used for larger purchases. For example, bakery bags are commonly used for small purchases, but if the buyer is obtaining a dozen of doughnuts, they are ordinarily put up in a foldable box. A box has the advantage that the weight of the stack of doughnuts is not on the bottom doughnuts because in the box, the doughnuts are placed on edge, each doughnut supporting only itself if the box is kept on its flat side. Users usually keep the box on its flat side because, unlike a bag, there is no folded down top by which to grasp it. However, boxes are quite expensive in cost, are bulky when shipped and bulky when stored in flat condition because of the thickness of the paper board itself and of the folded panels which do not flatten down the way that collapsible bags do.

SUMMARY OF THE INVENTION

A paper bag has a conventional rectangular bottom end, its side panels being so scored and cut as to define prospective integrally hinged end panels that are foldable and interlockable with each other so as to produce a rectangular closed end, thereby simulating a rectangular box when the same is filled and closed.

Accordingly, it is an object of the present invention to provide a collapsible bag having a construction that simulates a box.

A further object of the present invention is to provide a container which will serve as a box but is cheaper to produce and which will be collapsible to a flatter or thinner condition than a folded box.

Many other advantages, features and additional objects of the present invention will become manifest to those versed in the art upon making reference to the detailed description and the accompanying sheet of drawings in which a preferred structural embodiment incorporating the principles of the present invention is shown by way of illustrative example.

ON THE DRAWING

AS SHOWN ON THE DRAWINGS

Figure 1:
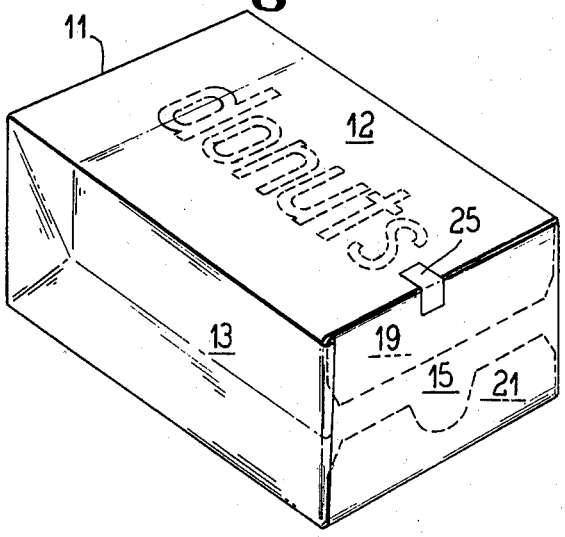
FIG. 1 is a perspective view of a bag provided in accordance with the invention, the bag being shown in a closed condition.
Figure 5:
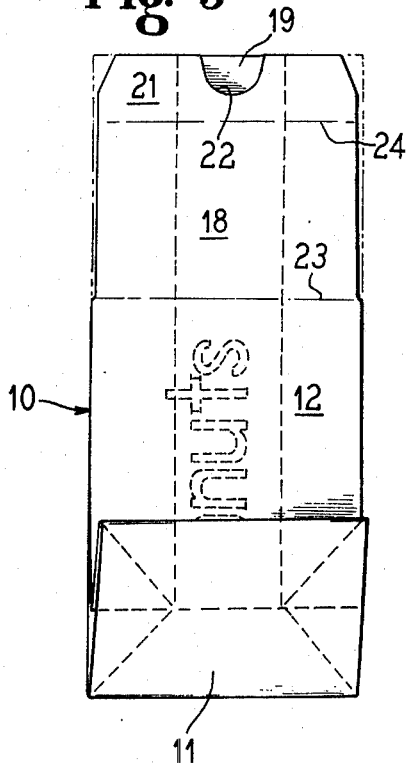
FIG. 5 is a view of the empty bag shown in a collapsed position which also diagrammatically illustrates a mode of manufacture thereof.

As shown in FIG. 5, a paper bag indicated generally by the numeral 10 is collapsible to a flat condition, a common form of such collapsibility being provided by a pleated rectangular bottom structure 11 which, when expanded as shown in FIG. 1, provides a rectangular left end, referred to in bags as the bottom, but here being the left end of FIG. 1 which here is obscured from full view. The bag 10 has four side panels 12–14, the side panel opposite to side panel 13 being obscured from view but being a mirror image of side panel 13.

According to the invention, at the mouth of the bag 10, there are provided four end panels 15–18 which are defined in part by scoring lines described more fully below to define prospective fold lines.

The outermost end panel 15 has a tab 19 which is also defined by a scoring line which serves as a prospective fold line described more fully below. The tab 19 has a tapered end or edges, the tapering being identified by the reference numeral 20. The intermediate end panels 16, 17 are in part defined by scoring lines to define their prospective fold lines, and the innermost end panel 18 is defined also by a similar score line. The innermost end panel 18 has a tab 21 which has a cutout 22 for facilitating expanding the bag from the flat form.

Figure 4:
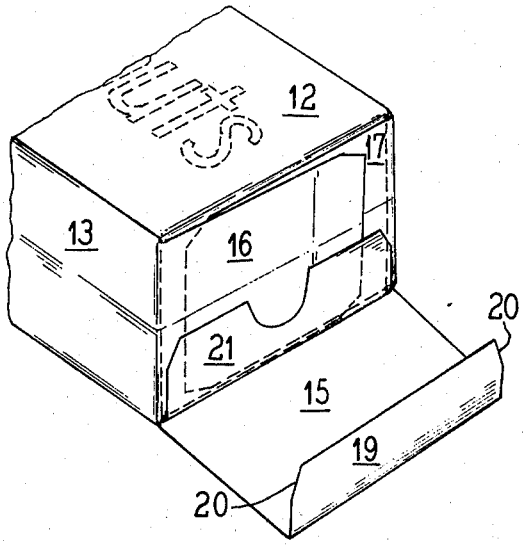
FIG. 4 is a perspective view of the structure of FIG. 2 shown three-fourths closed.
Figure 3:
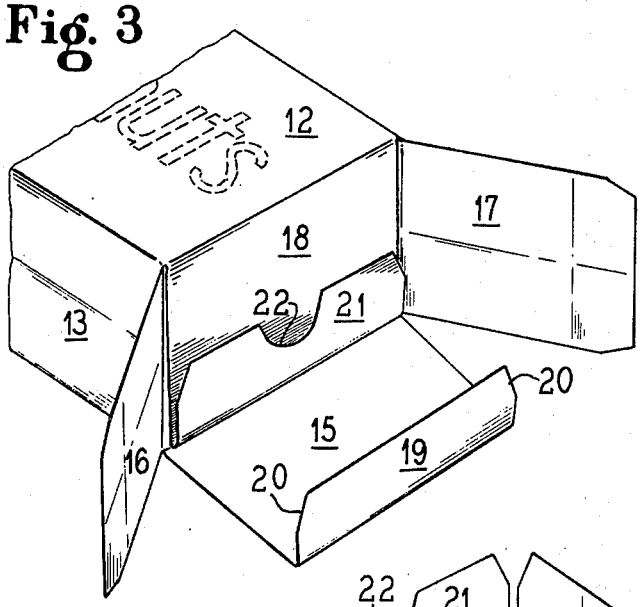
FIG. 3 is a perspective view of the structure of FIG. 2 shown one-fourth closed.
Figure 2:
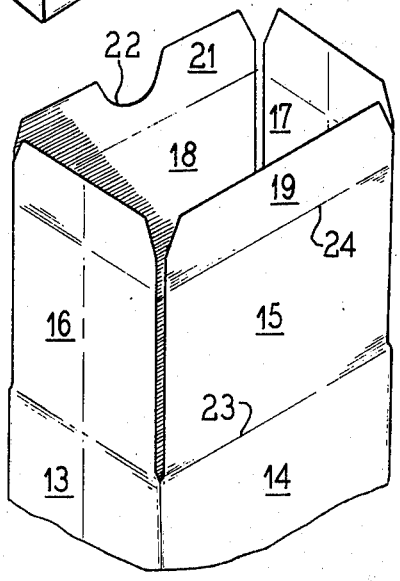
FIG. 2 is a perspective view of the mouth of the bag in an open condition.

The flat bag 10 is expanded from its flat form shown in FIG. 5 to the form shown in FIG. 2 for filling either in a vertical or in a horizontal position. As illustrated, the bag 10 is then placed in a horizontal position as shown in FIG. 3 and the end panel 18 is lowered. The end panels 16, 17 are then folded over or hinged into juxtaposition with the end panel as shown in FIG. 4. The tab 21 can be ignored at this point, but preferably it was depressed to be substantially horizontal before either of the end panels 16, 17 were moved to their closed position so that the tab 21 extends about an edge of each of these panels 16, 17, as shown in FIG. 4. Then the outermost panel 15 is also moved into juxtaposition with the tab 19 tucked in between the panels 18 and 17, thus extending about the other edges of the end panels 16, 17. With such insertion of the tab 19, the package takes on the box-like form or appearance as shown in FIG. 1 which is devoid of any customary folded-down top by which the same could be readily carried. With this arrangement, doughnuts are carried on edge as in a box, and the customer is not apt to carry this package any differently from the way a box would be carried.

The mode of manufacture of the bag is as follows. The bag is initially manufactured on automatic machinery so as to initially have the appearance and construction of a conventional flat collapsed bag having pleated side panels such as 13. It is laid in its flat or collapsed form as shown in FIG. 5 and then a cut is made at the side edges of the end panel 18 and its tab 21 to remove the material shown in a chain line. Such cut is made through all the thicknesses of the collapsed bag so that when it is opened, it has the structure of FIG. 2. Also, while flat, scoring is also completed. A score line or crimp or fold 23 is provided through all the thicknesses of the collapsed bag, the direction preferably being so that the convex side of the score line or hinge 23 is toward the viewer in FIG. 5, and a further score line 24 is made through all the thicknesses which is concave toward the viewer as seen in FIG. 5. Thus the end panel 18 has scoring which enables it to go naturally to the position shown in FIG. 3 and for its tab 21 to take that position naturally. The score line that defines the hinge of the intermediate end panels 16, 17 is half in one direction and half in the other, and thus there is no particular bias one way or the other, and the tapered ends thereof tend to remain more or less flat because of the oppositely directed curvatures of the portion of the score line 24 that extends therethrough. The hinging of the outermost panel 15, in this embodiment is in a direction opposite to the bias of its score line 23, but the hinging of its tab 19 is in the same direction as the bias of the score line 24 so that when it is tucked in as shown in FIG. 1 it naturally takes on a tight crimped appearance, thus adding to the neatness of the package.

As shown in FIG. 5, when flat, the score lines thus define hinges that are congruent as to both location and direction for the various end panels 15–18. Also, the score lines that define the hinges of the tabs 19, 21 are also congruent as to location and direction when flat. Further, the tapered ends 20 of the tab 19 converge such that they are congruent with adjacent portions of the other panels 16–18. When flat, the opposite cut ends of the end panels 15–18 are inset from the corresponding opposite ends of the pleated satchel bottom.

The tab 21 has yet another advantage. Where the contents of the bag 10 have a property such that the end panel 18 tends to adhere thereto, the fact that the tab 21 is directed away from the interior of the bag enables the tab 21 to be used as a pull tab to open the end panel 18 when it is in the position shown in FIG. 3.

If it is desired to seal the closed bag against tampering, such as when the bag is used for wholesale purposes in supermarkets, a piece of pressure-sensitive tape 25 or a drop of hot-melt adhesive can be utilized as holding means acting between the outermost panel 15 and at least one of the three remote side panels 12.

Although various minor modifications might be suggested by those versed in the art, it should be understood that I wish to embody within the scope of the patent warranted hereon all such embodiments as reasonably and properly come within the scope of my contribution to the art.

I claim as my invention:

1. A reclosable paper bag having one end that is rectangular from which there extends four side panels, there being four end panels at the opposite end secured to said side panels and disposed in overlapping relation to each other, the outermost one of said end panels having a tab underlying a portion of at least one of the adjacent ones of said end panels, the innermost end panel having a tab extending about the edge of at least one of the intermediate end panels.

* * * * *